United States Patent [19]

Schmehling

[11] 4,360,033

[45] Nov. 23, 1982

[54] FASTENING ELEMENT FOR HAIRPIECES

[75] Inventor: Gerhard Schmehling, Baden-Baden, Fed. Rep. of Germany

[73] Assignee: Schmehling GmbH, Baden-Baden, Fed. Rep. of Germany

[21] Appl. No.: 240,551

[22] Filed: Mar. 4, 1981

[30] Foreign Application Priority Data

Mar. 4, 1980 [DE] Fed. Rep. of Germany ..... 3008162

[51] Int. Cl.[3] ..... A41G 3/00

[52] U.S. Cl. ..... 132/53

[58] Field of Search ..... 132/53, 54, 5, 46, 48; 3/1

[56] References Cited

U.S. PATENT DOCUMENTS 1,686,636 10/1928 Oppenheim ..... 132/53

3,605,761 9/1971 Margo ..... 132/5

3,699,978 10/1972 Holly ..... 132/53

FOREIGN PATENT DOCUMENTS 2650157 5/1978 Fed. Rep. of Germany ..... 132/5

*Primary Examiner*—G. E. McNeill

*Attorney, Agent, or Firm*—Young & Thompson

[57] ABSTRACT

A fastening element for hairpieces comprises a one-piece flat body of resilient plastic, having recesses therein for detachable securement to a filament of a hairpiece. Rows of teeth are provided on opposite edges of the flat body about which a hank of the natural hair of the wearer can be wound to anchor the fastening element and hence the hairpiece, to the head of the wearer.

8 Claims, 8 Drawing Figures

FASTENING ELEMENT FOR HAIRPIECES

The present invention relates to a fastening element for holding a hairpiece to the remaining hair of the wearer.

It is known to use fastening elements for this purpose, which are in the form of double-faced, pressure-sensitive adhesive strips, hook and eye fasteners of the type trademarked "Velcro", spring clamps, clips with hinges, bands with holes nd eyes for knotting residual hairs, and nets. However, these known devices are unsatisfactory, because of bad fit, slipping, or bulky appearance, as a result of which they actually draw attention to the artificiality of the hairpiece that they secure.

It is accordingly an object of the present invention to overcome the difficulties of the known devices.

Another object of the present invention is the provision of a fastening element for hairpieces, which is simple in construction, easy to use, secure in its function, and which permits the quick and easy application and removal of the hairpiece by the wearer without help from others.

Briefly, the objects of the present invention are achieved by providing a fastening element on which a lock of the natural or residual hair of the wearer is rolled up, after which the device is secured to a filament such as a cord or ribbon on the rim of the hairpiece. This is done at at least two spaced points on the hairpiece, thereby to equalize the pull of the fasteners on the hairpiece and to prevent slippage or misalignment of the hairpiece.

Preferably, the fastener is a uniplanar member of thin material which is harmless to the skin, corrosion-proof and unbreakable, and preferably is stamped from a sheet of resilient plastic material.

Figure 1:
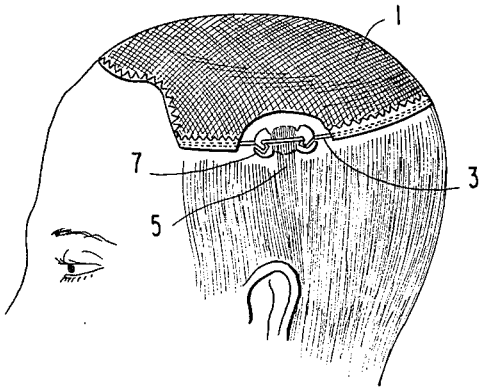
Figure 2:
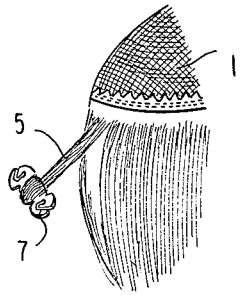

Other objects, features and advantages of the present invention will become apparent from a consideration of the following description, taken in connection with the accompanying drawing, in which:

FIG. 1 is a diagrammatic view, with parts broken away, of a hairpiece secured in place by a fastener according to the present invention;

FIG. 2 is a schematic view showing a lock of existing or natural hair being rolled up on the fastener of the present invention prior to securement to the hairpiece; and FIGS. 3–8 are broadside views of six different embodiments of fastening element according to the present invention, it being understood that in each of FIGS. 3–8, what is shown in a stamped-out section of thin uniplanar resilient plastic, so that end or edge views would be merely a straight line and hence are unnecessary.

Referring now to the drawing in greater detail, and first to FIGS. 1 and 2 thereof, it will be seen that a hairpiece 1 to be secured to the natural hair of the wearer, is provided with a marginal filament 3 in the form of a cord or ribbon or band; and it is by this filament 3 that the hairpiece is held to the head of the wearer.

A hank 5 of the natural or residual hair of the wearer, is separated from the rest of his hair and is rolled up on a fastening element 7 of the present invention, as seen in FIG. 2, after which this fastening element 7 is secured to the filament 3, whereby the hank 5 of the wearer's natural hair provides one of anchors for the hairpiece 1.

The same operation will be followed on at least the opposite side of the hairpiece, and preferably at a number of points spaced apart about the periphery of the hairpiece, until the hairpiece is secured firmly in place.

Of course, the operation of removing the hairpiece is equally easy: the fastener 7 is simply unsnapped from the filament 3, after which the fastener 7 is unrolled out of hank 5 and preserved for the time when the hairpiece is again to be applied.

Six alternative embodiments of the fastener according to the present invention are shown respectively in FIGS. 3–8 of the drawing. The first of them is the one shown in FIGS. 1 and 2, and comprises a fastener 7 having a midportion 9 that bears teeth 11 on opposite edges thereof. The teeth 11 are for the purpose of interlocking with the natural hair of the wearer, to provide a firm grip of the fastening device on that lock of hair and to facilitate rolling up the lock of hair on the fastening device.

At each end of each row of teeth 11, an abutment shoulder 13 guides the hank of hair onto the teeth 11 and prevents the hank from slipping endwise off the fastening device. These shoulders 13 thus define two enlarged ends 15 of the device, in each of which a circuitous slender slot 17 is cut which terminates at its inner end in an enlarged recess 19. The slots 17 permit the ends 15 to be deformed to the extent necessary to permit filament 3 to be engaged in recesses 19; and their circuitous nature assists in retaining the filament 3 in these enlarged recesses 19, in the position shown in FIG. 1.

It is also preferred that the filament 3 be threaded through the fastener 7 in the same way as shown in FIG. 1, namely, beneath a portion of ends 15 at each end of the fastener, and then above the intermediate portions of the fastener and the hank 5 of hair wound thereon.

Figure 3:
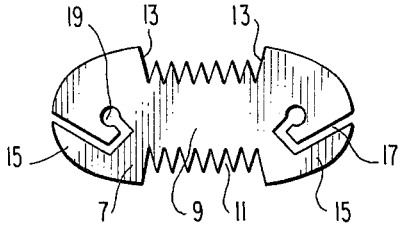

It is also to be understood that the fastener 7 shown in FIG. 3, like those in FIGS. 4–8, is stamped from a strip of resilient plastic which is naturally non-corrosive and bland to the skin and whose inherent resiliency preserves the shape of the fastener. Such fasteners may, for example, have a length of about one inch and a thickness of about 1/32 of an inch and be otherwise correspondingly proportioned as in the drawing.

Figure 4:
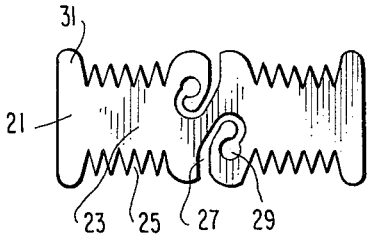

In the second alternative embodiment of fastener shown in FIG. 4, the fastener 21 is provided with two midportions 23 each of which has a row of teeth 25 on each of its opposite edges. The narrow slots 27 are central of fastener 21 and terminate inwardly in enlarged openings 29, the slots 27 and openings 29 being mirror images of each other and opening through opposite side edges of fastener 21. Enlargements 31 at each end of each row of teeth 25 prevent the hank of hair from slipping off the ends of the device.

Figure 5:
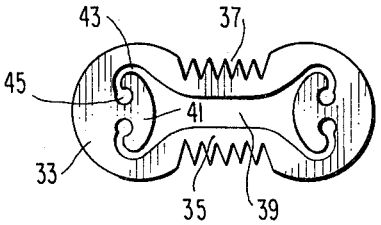

In FIG. 5, the fastener 33 has a central portion 35 with teeth 37 on its opposite edges, and a central opening 39 which does not open through the margins of fastener 33. Instead, opening 39 extends generally lengthwise of fastener 33 and has at each end a protruding portion 41 that extends into it, and which defines with the outer margins of opening 39 the narrow slots 43 that terminate inwardly in enlarged openings 45 for the reception of the hairpiece filament.

Figure 6:
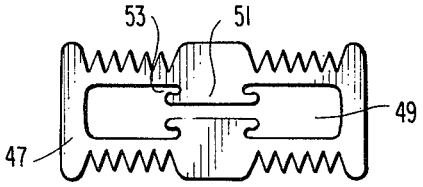

In FIG. 6, the fastener 47 has a central opening 49 that does not extend out through the margins of fastener 47, with projections 51 extending into opening 49 in directions opposite to those of the corresponding projections 41 in FIG. 5, thereby to define recesses 53 for the reception of the filament 3 of the hairpiece.

Figure 7:
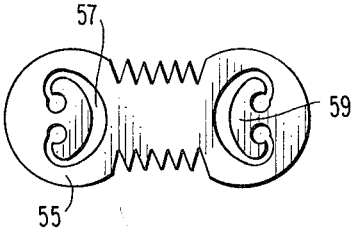

In FIG. 7, the fastener 55 is provided with two spaced and entirely enclosed openings 57 therethrough, each of which has one projection 59 extending thereinto, as in FIG. 5.

Figure 8:
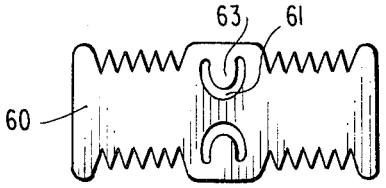

FIG. 8 shows a final embodiment of fastener 60, which in overall shape and function resembles that of FIG. 4 except that the openings 61 are entirely enclosed, the projections 63 extending into the openings 61 from opposite directions.

It is of course to be understood that the various embodiments of fastener are produced preferably by stamping and that the various teeth and projections and recesses and slots thus formed therein are integral with the body of the fastener.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A fastening element for hairpieces, comprising a one-piece flat body having recesses therein for detachable securement to a filament of a hairpiece, and teeth on opposite edges of said flat body about which a hank of the natural hair of the wearer can be wound.

2. A fastening element as claimed in claim 1, having slender circuitous slots therein that terminate inwardly in enlarged openings for the reception of a said filament of a hairpiece.

3. A fastening element as claimed in claim 1, having an enclosed opening therethrough, and a projection extending into said opening, said projection being adapted to retain a said hairpiece filament between the projection and the margins of the opening.

4. A fastening device as claimed in claim 1, and shoulders at the ends of each row of said teeth to prevent the natural hair of the wearer from slipping endwise off the fastening element.

5. A fastening element as claimed in claim 1, in combination with a hairpiece having a peripheral filament, said filament being threaded through said fastening element in secured relationship therewith, a hank of the hair of the wearer being wound about said fastening element and held on the fastening element by said filament.

6. A fastening element as claimed in claim 1, which is a uniplanar sheet of resilient plastic.

7. A fastening element as claimed in claim 3, there being a pair of said openings on opposite sides of the fastening device each having one said projection extending thereinto.

8. A fastening device as claimed in claim 3, there being a single central opening through said fastening device, and a pair of oppositely arranged said projections extending into said central opening.

* * * * *